US007355927B2

(12) United States Patent
Dalloz

(10) Patent No.: US 7,355,927 B2
(45) Date of Patent: Apr. 8, 2008

(54) DATE DISPLAY FOR TIMEPIECE

(75) Inventor: Jean-Pierre Dalloz, Lavans les Saint-Claude (FR)

(73) Assignee: Daniel Roth et Gerald Genta Haute Horlogerie S.A., Meyrin (CH)

( * ) Notice: Subject to any disclaimer, the term of this patent is extended or adjusted under 35 U.S.C. 154(b) by 356 days.

(21) Appl. No.: 10/958,760

(22) Filed: Oct. 5, 2004

(65) Prior Publication Data

US 2005/0088917 A1 Apr. 28, 2005

(30) Foreign Application Priority Data

Oct. 24, 2003 (EP) ..... 03405763

(51) Int. Cl.
*G04B 19/20* (2006.01)

(52) U.S. Cl. ..... 368/37

(58) Field of Classification Search ..... 368/28, 368/35, 37

See application file for complete search history.

(56) References Cited

U.S. PATENT DOCUMENTS 3,779,001 A * 12/1973 Kocher et al. ..... 368/38
3,846,975 A 11/1974 Masui
3,977,179 A * 8/1976 Bachmann ..... 368/231
3,982,388 A * 9/1976 Guyot et al. ..... 368/35
5,805,533 A * 9/1998 Daigle et al. ..... 368/226
2004/0170088 A1* 9/2004 Seyr ..... 368/110
2005/0018545 A1* 1/2005 Seyr ..... 368/227

FOREIGN PATENT DOCUMENTS

| | | |
|---|---|---|
| CH | 5 139 | 10/1892 |
| CH | 310 559 | 10/1955 |
| EP | 1070996 | 1/2001 |
| WO | WO 03/042764 A2 * | 5/2003 |
| WO | WO 03/071361 A2 | 8/2003 |
| WO | WO 03/071361 A3 | 8/2003 |

* cited by examiner

*Primary Examiner*—Vit W Miska
(74) *Attorney, Agent, or Firm*—Sturm & Fix LLP

(57) ABSTRACT

This date display for a timepiece, comprising two side by side indicator disks (1, 2), one (1) bearing the figures for the units, the other (2) those for the tens, the two side by side figures of the two respective disks (1, 2) appearing in a window (3) provided through a time indicator dial. These two disks (1, 2) are transparent and the surface (4) subjacent to said disks (1, 2), appearing in said window (3) and through said disks (1, 2), is of a contrasting color relative to that of said figures.

9 Claims, 1 Drawing Sheet

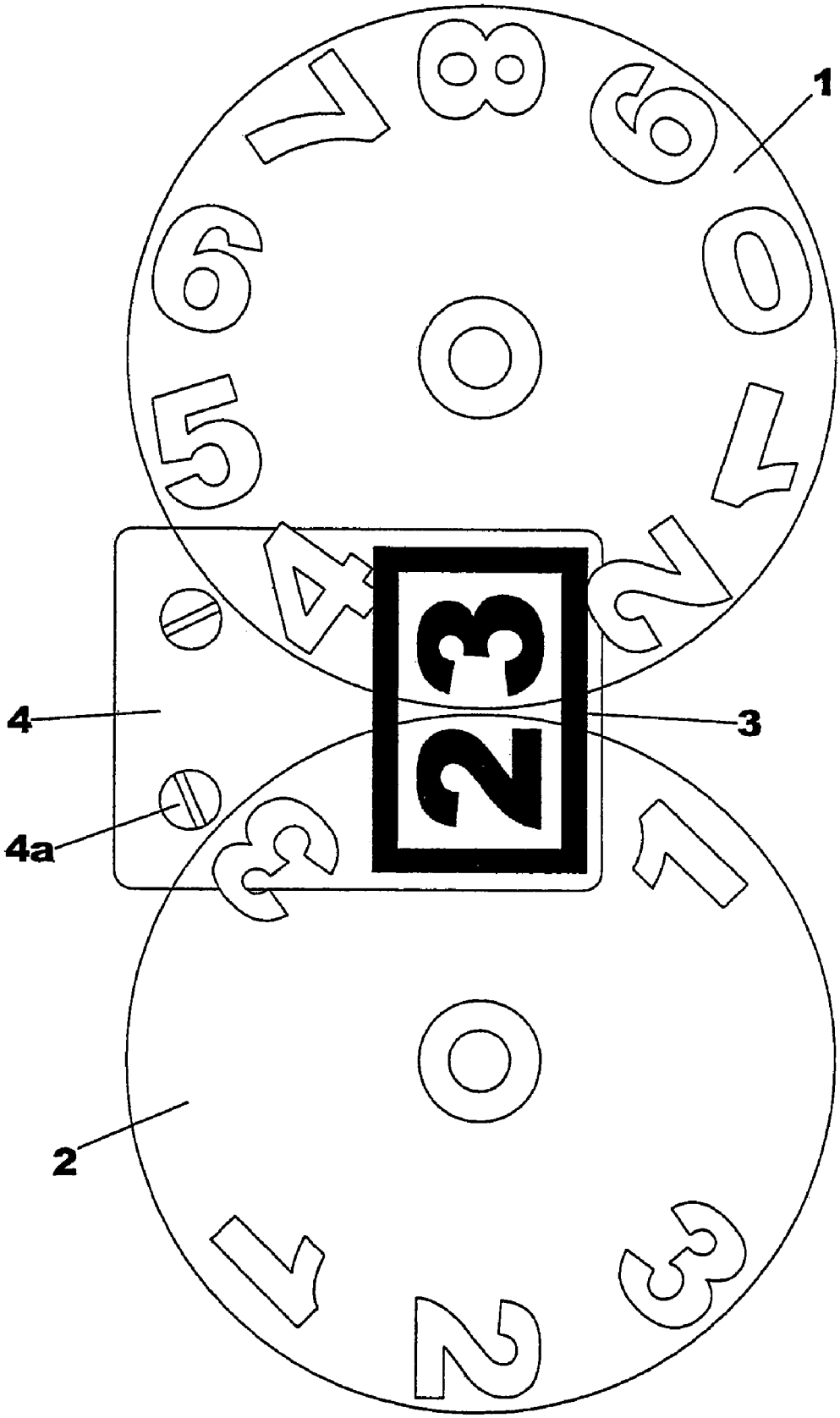
1
2
3
4
4a

DATE DISPLAY FOR TIMEPIECE

CROSS REFERENCE TO RELATED APPLICATIONS

This application is claims priority of European Application No. 03405763.8 filed Oct. 24, 2003, which is included in its entirety by reference made hereto.

BACKGROUND OF THE INVENTION

1. Field of the Invention

The subject of the present invention is a date display for a timepiece, comprising two side by side indicator disks, one bearing the figures for the units, the other those for the tens, the two side by side figures of the two respective disks appearing in a window provided through a time indicator dial.

2. Description of Related Art

In order to allow an increase in size of the date figures of a wristwatch, in particular, it has already been proposed to use two disks, one bearing the units figures and the other the tens figure. When these disks are disposed side by side, in such a way as to reveal through a window the two adjacent portions of these disks situated on either side of a line connecting their respective centers, those portions of the edges of the disks which are situated inside the window appear. In order to conceal these disk edges, the window is generally divided in two by a narrow central vertical crosspiece, providing a left-hand half-window for displaying the tens figure and a right-hand half-window for displaying the units.

Solutions have also been proposed in which the two disks are placed one on top of the other, one of the figures appearing through an opening provided in the upper disk. This solution has the drawback, however, of having the two date figures situated at two different levels. It has also been proposed, in EP 1 070 996, to make the upper disk of a transparent material, which avoids having to provide an opening but does not solve the problem of the two figures being displayed at different levels.

Another variant of the preceding solution is described in WO 03/071361 and has, therefore, the same drawback, namely that of displaying the two date figures on two different levels.

BRIEF SUMMARY OF THE INVENTION

The aim of the present invention is to provide a solution that can solve, at least partially, the abovementioned drawbacks.

To this end, the subject of this invention is a date display for a timepiece as claimed in claim 1.

BRIEF DESCRIPTION OF THE DRAWINGS

The sole FIGURE of the appended drawing illustrates diagrammatically, and by way of example, a top view of an embodiment of the display forming the subject of the present invention.

DETAILED DESCRIPTION OF THE INVENTION

For an understanding of the present invention, the person skilled in the art has no need to be familiar with the drive mechanism of the display, this being a wholly traditional date display of the type referred to as "large date", well known to the person skilled in the art. By virtue of this mechanism, the units disk is driven by one step each day and that of the tens by one step every ten days. At the end of the month, whether it may be an annual or a perpetual date mechanism, the passage from the 28, 29, 30 or 31 to the 1 of the following month will be realized automatically by a known mechanism which, if the month has 31 days, neutralizes the units disk and only drives the tens disk, or which, if the month has 30 days, drives both of the disks by one step. If the mechanism is perpetual, it will carry out the adjustment also for the month of February. Finally, if it is case of a simple date, the adjustment is carried out manually whenever the month has less than 31 days.

The display according to the invention thus comprises two side by side disks, a units disk 1 bearing the figures from 0 to 9 and a tens disk 2 bearing at least one series of four figures 0 to 3, the 0 being replaceable by an empty space or by a decorative element. Preferably, the tens disk comprises two series of figures from 0 to 3, which allows it to come closer to the number of figures of the units disk and thus allows two disks to be made having substantially the same diameter.

These two disks 1, 2 are transparent, the figures which they bear being of a color, for example black, as normal. Only those parts of these disks 1, 2 which are situated inside the window, represented in the drawing by a rectangle 3, are visible to the observer, such that the drive mechanism of these disks 1, 2 may easily be situated outside the field of vision of the window 3. Beneath these parts of the disks 1, 2, and preferably a little way beyond to take account of the parallax, the surface which appears through these parts of the transparent disks 1, 2 is of a color contrasting with that of the figures borne by these disks, for example, if the figures are black, the surface which appears through the disks 1, 2 will be white or at least clear. Given that the disks are transparent, their respective edges are nearly invisible, such that it is no longer necessary to divide the window 3 in two with a central crosspiece to hide the edges of the disks 1, 2.

The surface subjacent to the disks 1, 2, appearing transparently in the window 3, can be provided on a plate 4 fixed to the casing, in general to the bottom plate of the timepiece by screws 4*a*. Where that portion of the casing which is situated beneath the window 3 has a plain surface, the plate 4 may be omitted and the contrasting surface intended to appear beneath those portions of the disks 1, 2 which are situated in the window 3 can be provided directly on the bottom plate by total or partial coating of the latter in the desired contrasting color. If the conducted tests have shown that the white background and the black figures yield good results, then the reversal of this, with white figures on a black background, can equally be considered. At first sight, however, this solution would appear to be less favorable. Given that the transparent disks produce a reflection, it may be advantageous to choose a bright contrasting color in order to temper the difference between those portions of the background surface 4 which are covered by the disks 1, 2 and those zones 4*a* of this same background surface which are situated between the disks 1, 2 and which are not covered by them.

The transparent disks 1, 2 may be made of a plastics material or of glass. Where they are made of a plastics material, they could be obtained by injection by positioning figures produced, for example, by cutting in such a way in the injection mold that they are at least partially embedded in the injected plastics material. These figures could have a certain thickness, for example corresponding to the thickness of the transparent disk 1, 2, which would lend them a particular relief, hitherto unknown, since the cut edge of these figures, given that they are embedded in a transparent disk, would then be seen.

The invention claimed is:

1. A date display for a timepiece, comprising two side by side indicator disks rotating about different axes, one bearing the figures for the units, the other figures for the tens, the two side by side figures of the two respective disks appearing in a window provided through a time indicator dial, wherein the two disks are transparent and wherein the surface subjacent to said disks, appearing in said window and through said disks, is of a contrasting color relative to that of said figures.

2. The display as claimed in claim 1, in which the contrasting color of said surface subjacent to said disks is bright.

3. The display as claimed in claim 1, wherein said figures are embedded in a plastics material forming said disks.

4. The display as claimed in claim 2, wherein said figures are embedded in a plastics material forming said disks.

5. The display as claimed in claim 1, wherein said subjacent surface is provided on an element mounted on the casing of the timepiece.

6. The display as claimed in claim 2, wherein said subjacent surface is provided on an element mounted on the casing of the timepiece.

7. The display as claimed in claim 1, wherein said two side by side indicator disks are at the same level.

8. A date display for a timepiece, comprising two side by side indicator disks having substantially the same diameter, one bearing the figures for the units, the other figures for the tens, the two side by side figures of the two respective disks appearing in a window provided through a time indicator dial, wherein the two disks are transparent and wherein the surface subjacent to said disks, appearing in said window and through said disks, is of a contrasting color relative to that of said figures.

9. The display as claimed in claim 8, wherein said two side by side indicator disks are at the same level.

* * * * *